US008038062B2

(12) United States Patent
Kenefic

(10) Patent No.: US 8,038,062 B2
(45) Date of Patent: Oct. 18, 2011

(54) METHODS AND APPARATUS FOR PATH PLANNING FOR GUIDED MUNITIONS

(75) Inventor: Richard J. Kenefic, Ft. Wayne, IN (US)

(73) Assignee: Raytheon Company, Waltham, MA (US)

( * ) Notice: Subject to any disclaimer, the term of this patent is extended or adjusted under 35 U.S.C. 154(b) by 1169 days.

(21) Appl. No.: 11/758,340

(22) Filed: Jun. 5, 2007

(65) Prior Publication Data

US 2010/0264216 A1 Oct. 21, 2010

(51) Int. Cl.
*G06G 7/80* (2006.01)

(52) U.S. Cl. ..... 235/400

(58) Field of Classification Search ..... 235/400; 244/3.15, 3.22

See application file for complete search history.

(56) References Cited

U.S. PATENT DOCUMENTS 5,548,516 A 8/1996 Gudat et al.
5,610,815 A 3/1997 Gudat et al.
5,612,883 A 3/1997 Shaffer et al.
5,615,116 A 3/1997 Gudat et al.
5,640,323 A 6/1997 Kleimenhagen et al.
5,646,843 A 7/1997 Gudat et al.
5,646,845 A 7/1997 Gudat et al.
5,648,901 A 7/1997 Gudat et al.
5,657,226 A 8/1997 Shin et al.
5,680,306 A 10/1997 Shin et al.
5,680,313 A 10/1997 Whittaker et al.
5,684,696 A 11/1997 Rao et al.
5,838,562 A 11/1998 Gudat et al.
5,956,250 A 9/1999 Gudat et al.
6,254,031 B1 * 7/2001 Mayersak ..... 244/3.22
6,279,851 B1 * 8/2001 Huss et al. ..... 244/3.15

OTHER PUBLICATIONS

Steven M. Lavalle, Sampling-Based Planning Under Differential Constraints, Planning Algorithms, 2006, pp. 787-860, Cambridge University Press.

* cited by examiner

*Primary Examiner* — Daniel Hess
(74) *Attorney, Agent, or Firm* — Daly, Crowley, Mofford & Durkee, LLP

(57) ABSTRACT

Methods and apparatus for providing path planning for a guided munition. In one embodiment, a boundary value problem solver is used to guide the munition from one configuration to another configuration at a different altitude using a waypoint-based search tree where a number of leaves grows linearly with the depth of the tree.

7 Claims, 16 Drawing Sheets

METHODS AND APPARATUS FOR PATH PLANNING FOR GUIDED MUNITIONS

BACKGROUND

As is known in the art, certain munitions can be guided in flight. Excalibur and Extended Range Guided Munition (ERGM) are examples of munitions that can be redirected in flight. As will be readily appreciated, there are several advantages to firing munitions with this capability. For example, since the munitions do not follow a passive ballistic trajectory, it is not possible for an enemy to determine the position of the launching tube from radar measurements of the munition in flight. In addition, targets at different ranges and azimuths can be engaged without re-positioning the launching tube so as to increase the rate of fire. Further, targets that cannot be engaged with a passive ballistic trajectory due to terrain shadowing can be engaged with maneuverable munitions. Also, munitions in flight can be regarded as fire assets that can be re-directed to destroy high value pop-up targets.

While guided munitions can be quite effective, there are challenges in efficiently generating path planning options for inflight munitions. As is known in the art, path planning under kinematic constraints has been a topic of research in the robotics community. Many of the results obtained for the so-called Dubins car can be applied to loitering weapons, such as unmanned aerial vehicles (UAVs). However, there has been little progress in path planning for global positioning satellite (GPS) guided indirect fire weapons, e.g., Excalibur, ERGM, and the NLOS PAM. This class of indirect fire weapons has limited maneuver capability and difficult kinematic constraints compared to loitering weapons.

SUMMARY

The present invention provides methods and apparatus for efficiently performing path planning for a guided munition. In general, a two point boundary value problem solver is used at altitude increments to fly the munition from one configuration to the next configuration. A waypoint-based search tree generates a search tree such that the number of leaves grows linearly with the depth of the tree. While exemplary invention embodiments are shown and described in conjunction with particular munitions having associated path planning criteria, it is understood that the invention is applicable to objects in general for which it is desirable to plan a path.

In one aspect of the invention, a method comprises planning a path to a target for an airborne guided munition, including initiating a search tree, selecting an aimpoint using waypoint information to generate a branch of the search tree for a potential path to the target, performing two point boundary value processing for the aimpoint to generate the branch, determining whether a violation occurs for the branch, adding the branch to the search tree if the violation did not occur, and repeating steps to form feasible paths to the target from the formed branches, and selecting a first one of the feasible paths.

In another aspect of the invention, a method comprises performing path planning for a guided munition by: solving a two point value boundary problem to fly the munition from a first configuration to a second configuration having a different altitude than the first configuration, and generating a waypoint-based search tree that grows linearly with a depth of the search tree for generating feasible paths for the munition.

In a further aspect of the invention, a system to provide path planning for a guided munition comprises a processor and a memory, an operating system to support the processor and memory, an initializer module to initialize a search tree, a terrain data database to store terrain data for identifying invalid paths for the munition, a waypoint module to provide waypoint information for generating branches of the search tree, an aimpoint module coupled to process aimpoints using the waypoint information, a boundary value problem module to perform boundary value problem processing to generate branches for the search tree to form feasible paths for the munition, feasible path module to select a first one of the feasible paths, and an interface module to communicate with the munition.

BRIEF DESCRIPTION OF THE DRAWINGS

The foregoing features of this invention, as well as the invention itself, may be more fully understood from the following description of the drawings in which.

DETAILED DESCRIPTION

Figure 1:
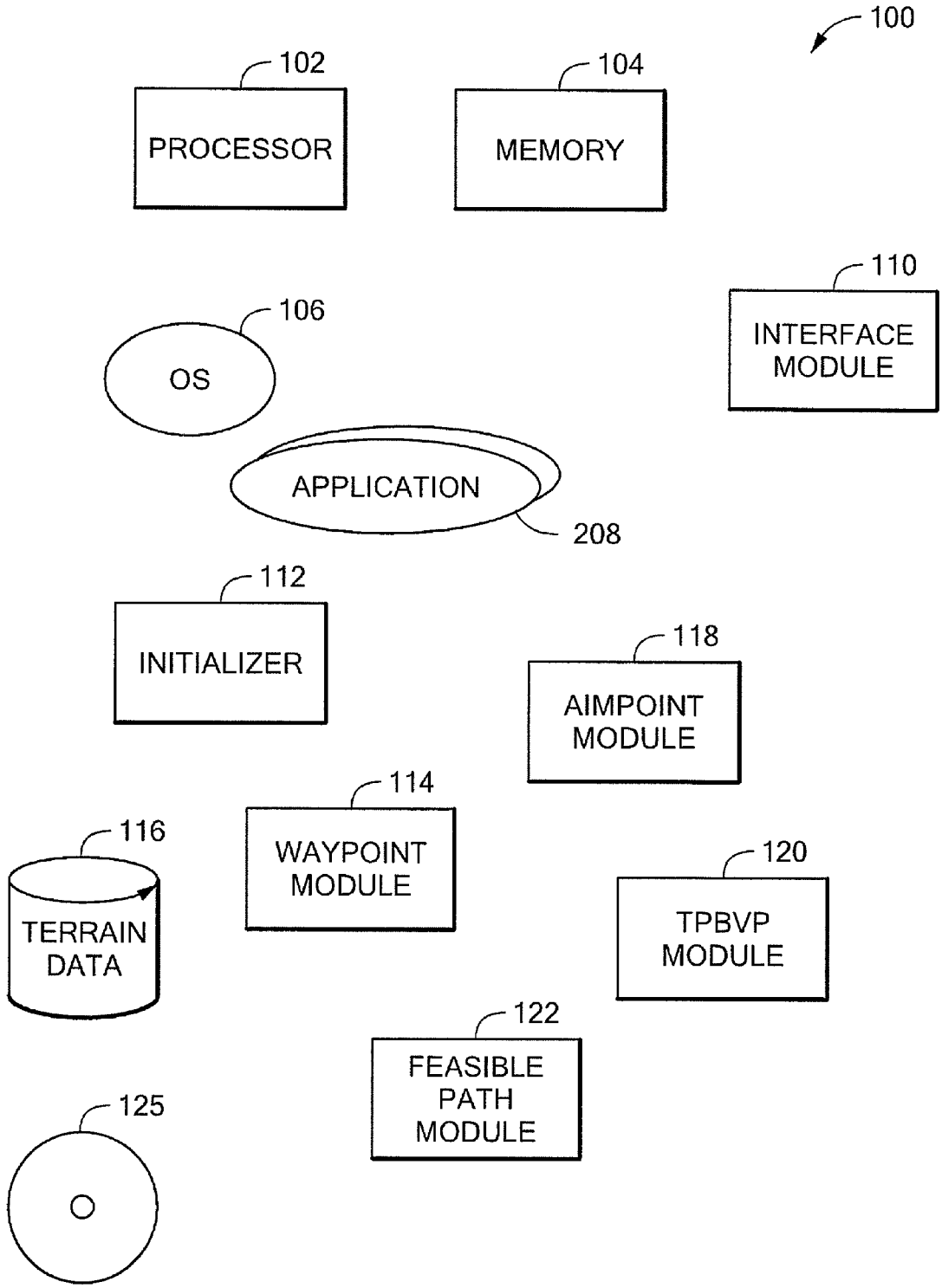
FIG. 1 is a path planning system in accordance with exemplary embodiments of the invention.
Figure 1A:
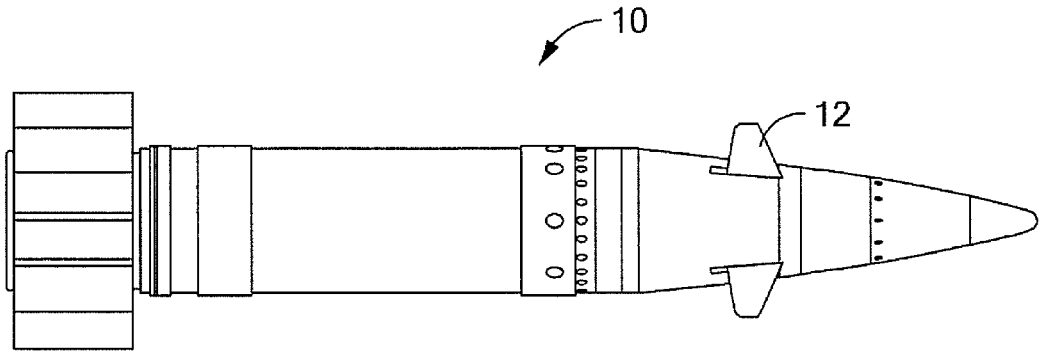
FIG. 1A is a guided munition in accordance with exemplary embodiments of the invention.

The present invention provides methods and apparatus for path planning for guided, such as by GPS (Global Positioning Satellites), indirect fire munitions. FIG. 1 shows an exemplary system 100 providing path planning for a guided munition, such as the munition 10 shown in FIG. 1A. The illustrated munition 10 is provided as an Excalibur-type rocket-assisted, spin-stabilized munition that uses GPS for guidance into a target by adjustment of canards 12 under the control of an autopilot, for example.

The exemplary path planning system 100 includes a processor 102 supported by memory 104 under the control of an operating system (OS) 106. A series of applications 108 run on the operating system 106 in a manner well known in the art. The system 100 further includes an interface module 110 to enable communication with the munition 10 either remotely via a wireless internet connection or locally for a path planning system resident on the munition and other systems local or remote involved in the command and control of the munition. Such communication systems are well known to one of ordinary skill in the art.

In an exemplary embodiment, the system 100 includes an initializer module 112 to initialize a path planning search tree.

A waypoint module 114 contains waypoint information used to determine path boundaries and a terrain database 116 contains terrain information. An aimpoint module 118 selects aimpoints for evaluation by the TPBVP module 120. A feasible path module 122 selects an optimal path from feasible paths. In one embodiment, a disk 125, or any suitable medium, can contain machine-readable instructions that can be executed by one or more computers to perform the inventive processing. Processing is described in detail below.

Before describing the invention in detail, some initial information is provided. If a fired munition is to be regarded as an asset that can be redirected toward a high value pop-up target, for example, then it must be possible to determine if that target can be destroyed by the munition. In an exemplary embodiment, this determination is made external to the munition (i.e., the munition is not asked to calculate if it can kill the target). The munition configuration is assumed known at regular time intervals. In alternative embodiments, the munition determines whether the target can be killed.

Figure 2:
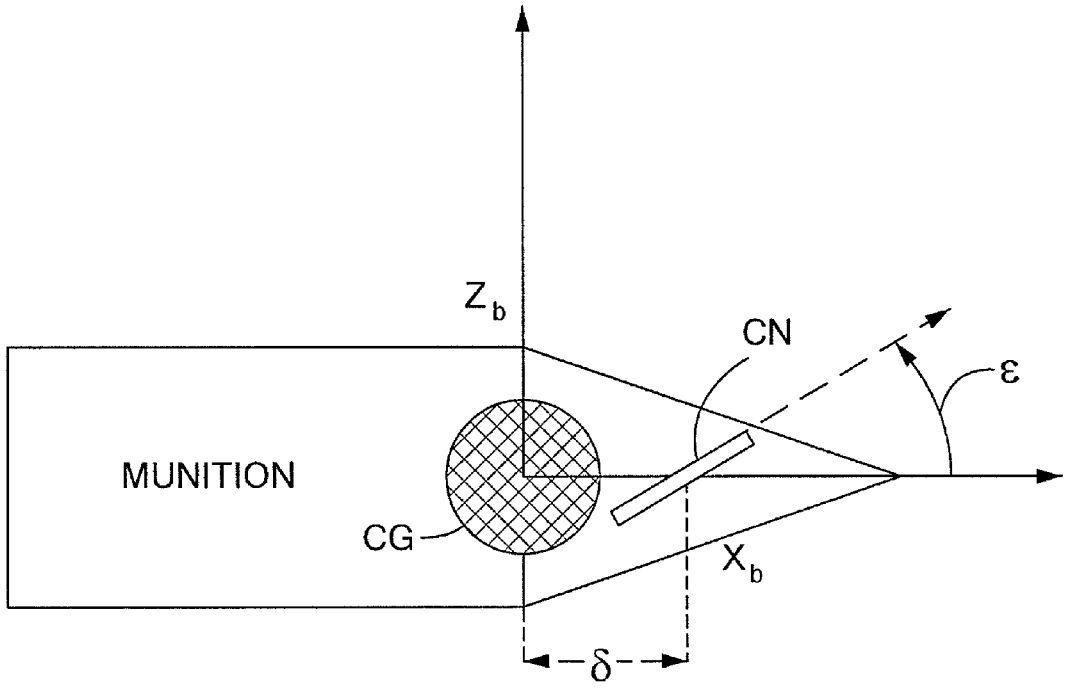
FIG. 2 is a representation of a reference frame for a munition.

Consider the body reference frame shown in FIG. 2 showing the center of gravity (CG) for the munition and a canard CN. The variables $\delta$ and $\epsilon$ represent the distance between the elevator chord and center of gravity and the elevator angle, respectively. The body normal and axial forces are $\underline{L}_b$ and $\underline{D}_b$ respectively where normal is in the positive $Z_b$ direction and axial in the negative $X_b$ direction. Note that Lift and drag are typically in the wind reference frame with axial and normal reserved for the body reference frame. Both $\underline{L}_b$ and $\underline{D}_b$ are functions of mach number, m, and angle of attack, $\underline{\alpha}$. The incremental elevator normal and axial forces are $\underline{L}_e$ and $\underline{D}_e$ respectively with identical directions and dependencies vis-à-vis the body forces, but with an additional dependence on elevator angle, $\epsilon$.

Figure 3:
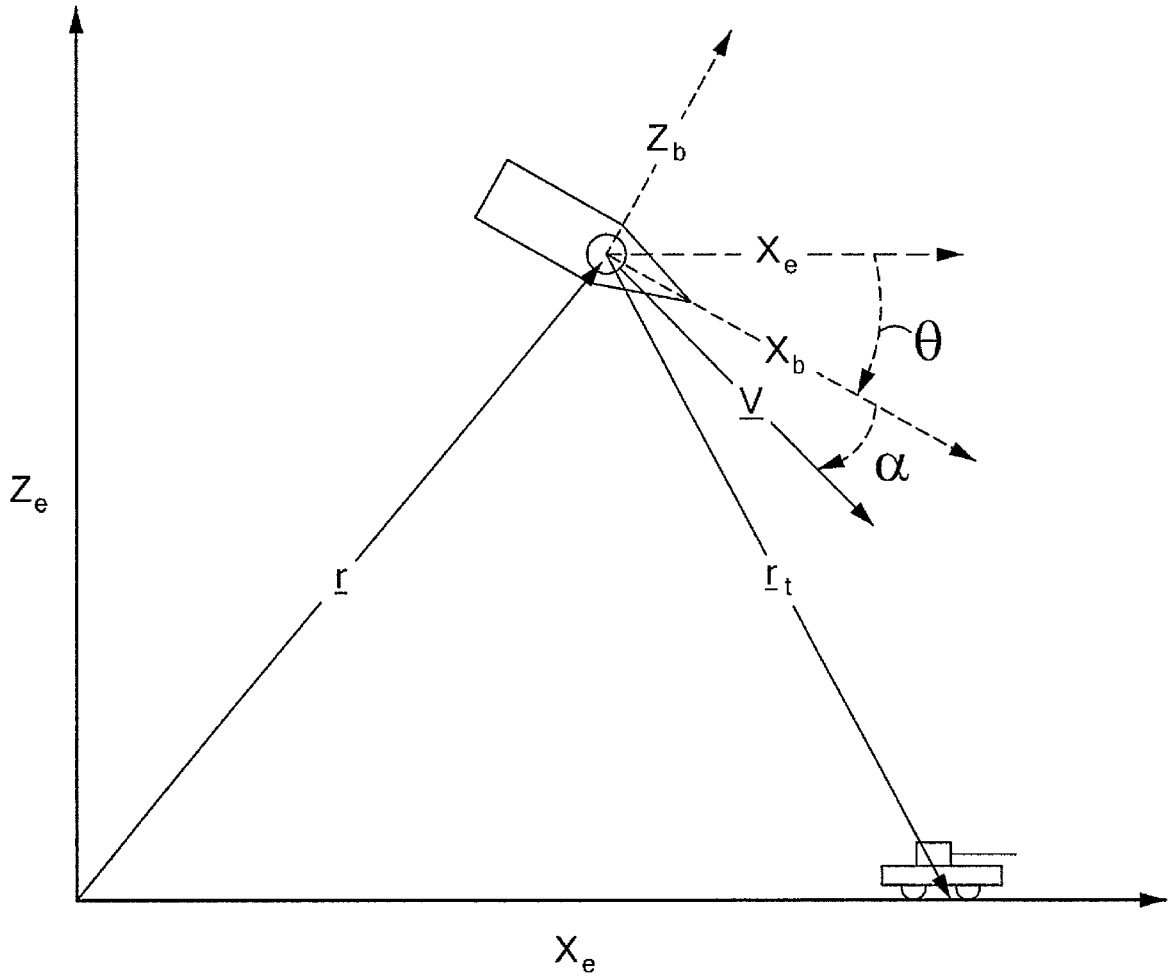
FIG. 3 is a representation of an inertial reference frame for a munition.

FIG. 3 shows the earth (inertial) reference frame. The munition is located at $\underline{r}$ and the target is at $\underline{r}_t$ from the munition CG. The munition velocity is v, angle of attack is $\alpha$, and pitch is $\theta$. This is a three degree of freedom (3DOF) system (x, z, $\theta$). The second order nonlinear differential equations of motion for this system can be integrated to determine the munition trajectory given the initial conditions and the autopilot control law used to steer the munition into the target.

Summing forces and moments in the inertial frame it follows that $$M\ddot{x}=-D_t(m,\alpha,\epsilon)\cos(\theta)-L_t(m,\alpha,\epsilon)\sin(\theta)$$

$$M\ddot{z}=-D_t(m,\alpha,\epsilon)\sin(\theta)+L_t(m,\alpha,\epsilon)\cos(\theta)-Mg \tag{1a}$$

$$I\ddot{\theta}=\delta L_e(m,\alpha,\epsilon)+D(m)\dot{\theta} \tag{1b}$$

where M is mass, I is moment of inertia, $D_t=D_b+D_e$ and $L_t=L_b+L_e$ are the total normal and axial forces, g is acceleration of gravity, and D(m) is the pitch damping moment coefficient. Expressing the velocity in the body reference frame leads to $$\alpha=a\tan 2(-\dot{x}\sin(\theta)+\dot{z}\cos(\theta),\dot{x}\cos(\theta)+\dot{z}\sin(\theta)) \tag{2}$$

where a tan 2 is the four quadrant $\tan^{-1}$. The mach number is $$m=\sqrt{\dot{x}^2+\dot{z}^2}/c(z) \tag{3}$$

where c is the speed of sound at altitude z. Normal force, axial force, and pitch moment, $\delta L_e(m,\alpha,\epsilon)$, are obtained from the corresponding coefficients in the aero database multiplied by the dynamic pressure, $$q_{dyn}=\frac{1}{2}\rho(z)(\dot{x}^2+\dot{z}^2)S,$$

where $\rho$ is the air density and S is a projected or characteristic area. The pitch damping moment coefficient is $$D_{\dot{\theta}}(m)=\frac{1}{2}C_{MQ}(m)q_{dyn}SL^2\Big/\sqrt{\dot{x}^2+\dot{z}^2}$$

where L is a characteristic length and $C_{MQ}(m)$ is obtained from the aero database. The equations of motion (1)-(3) will be complete when the elevator angle control law has been specified.

In general, exemplary embodiments of the invention provide path planning under kinematic constraints by efficiently solving a two point boundary value problem (TPBVP) to find the path that moves the weapon from one configuration to another. An efficient search tree takes the weapon from an initial configuration to a goal configuration with the search tree expanding based on waypoint selection. With this arrangement, a memory efficient approach is provided for connecting the initial and goal configurations. In one embodiment, a search tree is grown from the initial configuration toward the goal, and terminates those branches that violate spatial constraints, such as terrain and restricted airspace.

Embodiments of the invention are described below using examples that make use of aero data provided by Raytheon RMS for the Excalibur system. It is understood, however, that any suitable aero data can be used to meet the needs of a particular application. It should be noted that the data is 3DOF (three degrees of freedom) so the described exemplary path planning process is two-dimensional (2D). It will be readily apparent to one of ordinary skill in the art that generalization to a three-dimensional (3D) planner is a straightforward extension of the 2D case. In addition, because Excalibur is not very maneuverable, in an exemplary embodiment the inventive path planner is restricted to a single waypoint. Generalization to multiple waypoints is straightforward and well within the scope of the invention.

Figure 4A:
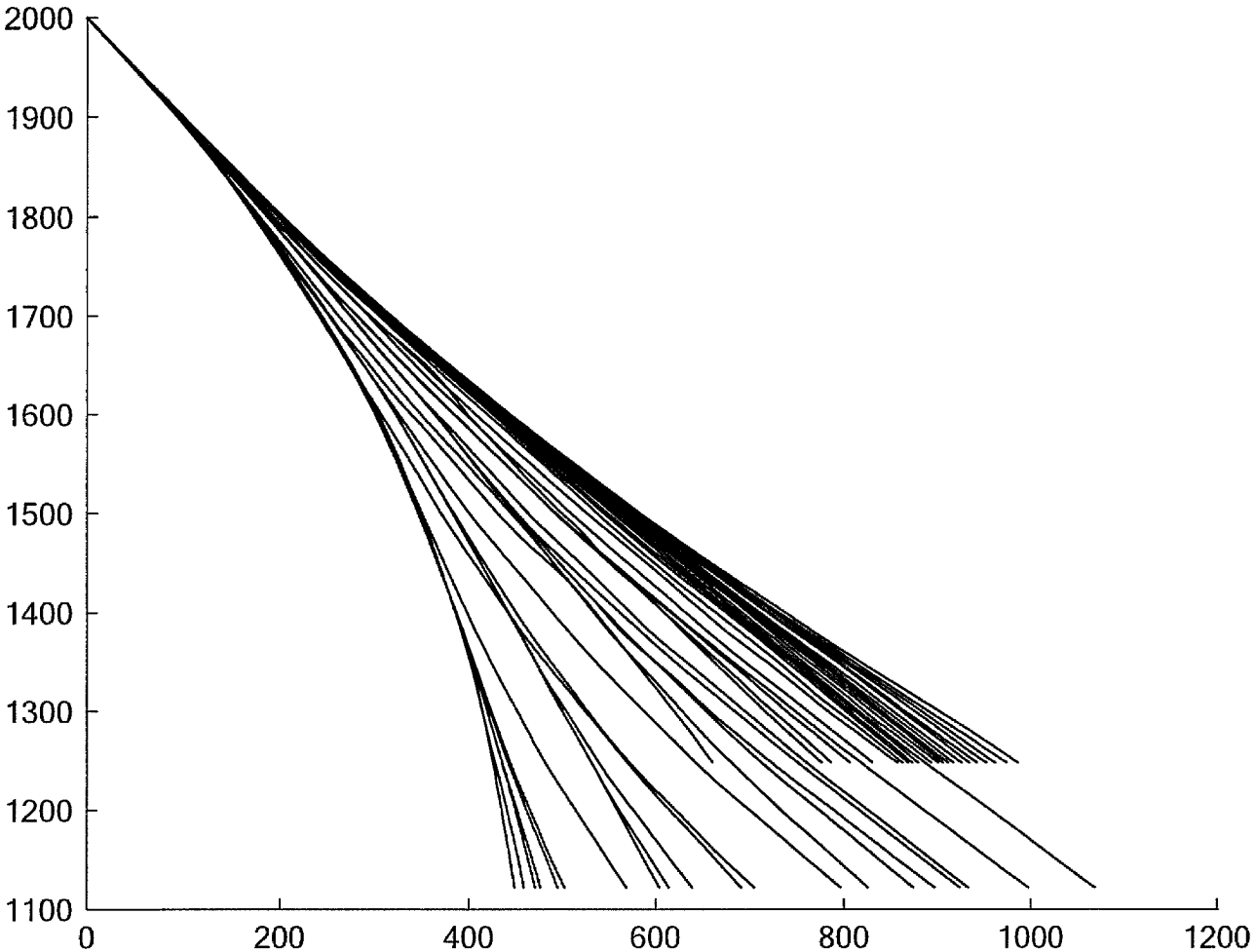
FIGS. 4A-4D are snapshots of a search tree being generated in accordance with exemplary embodiments of the invention.
Figure 4B:
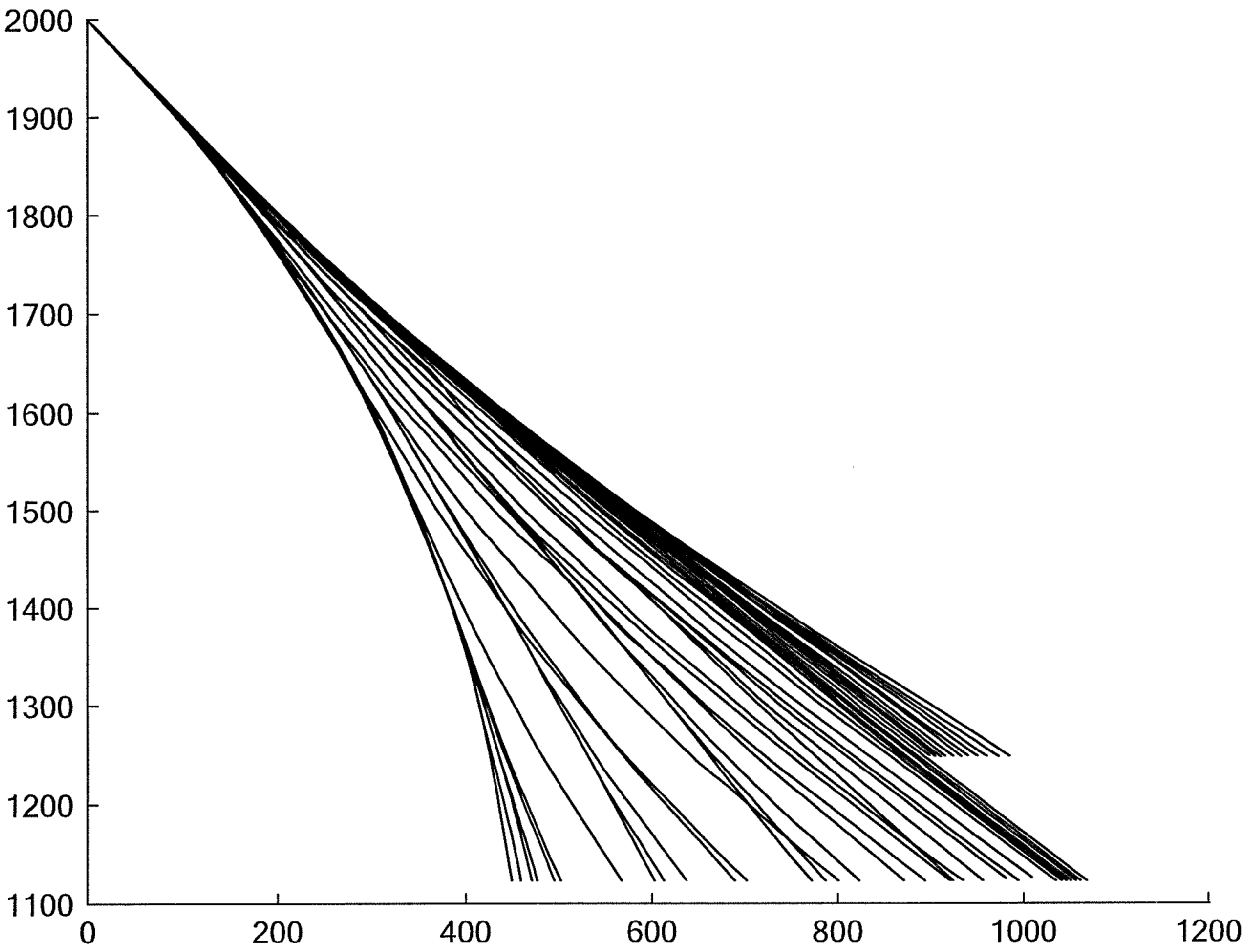
Figure 4C:
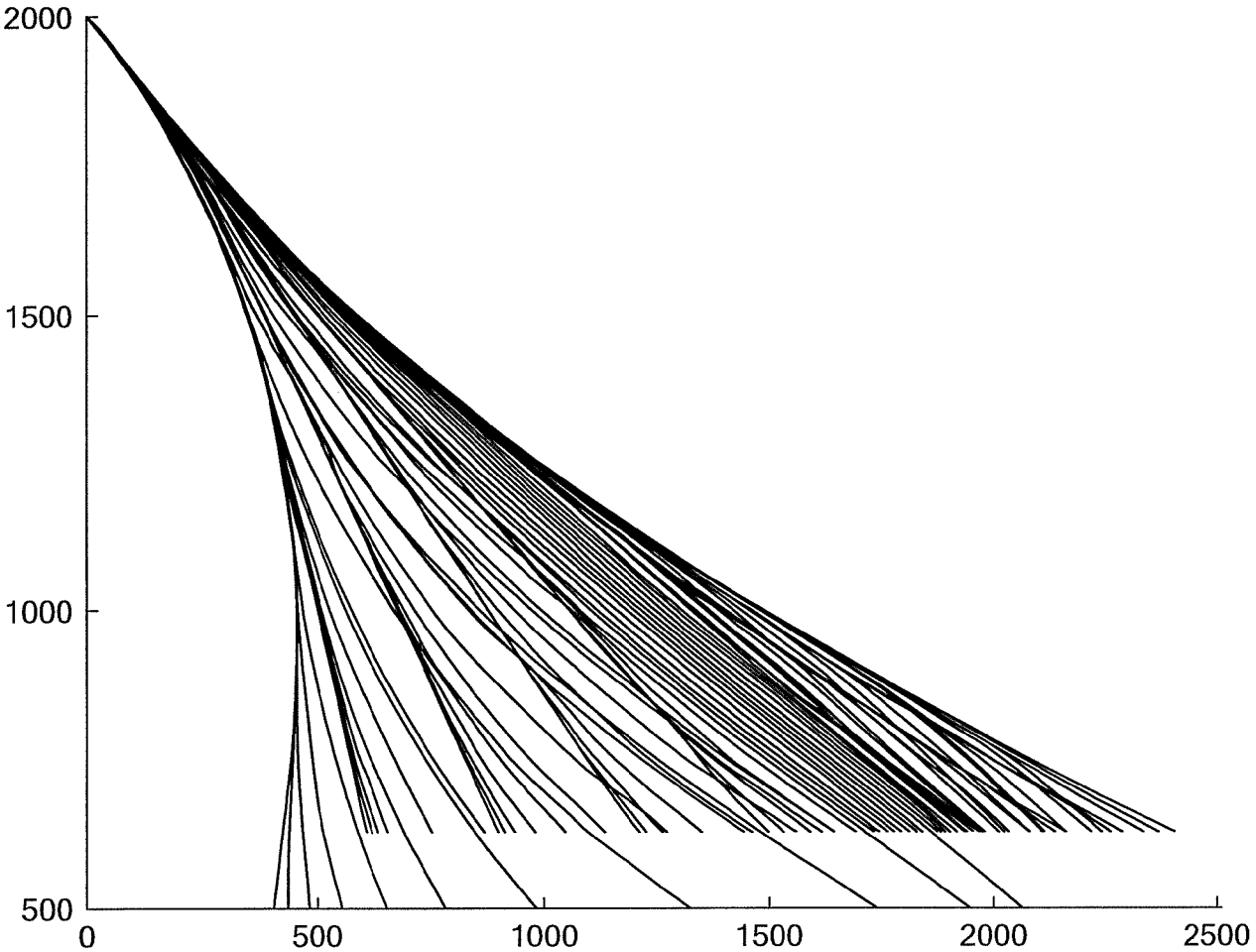
Figure 4D:
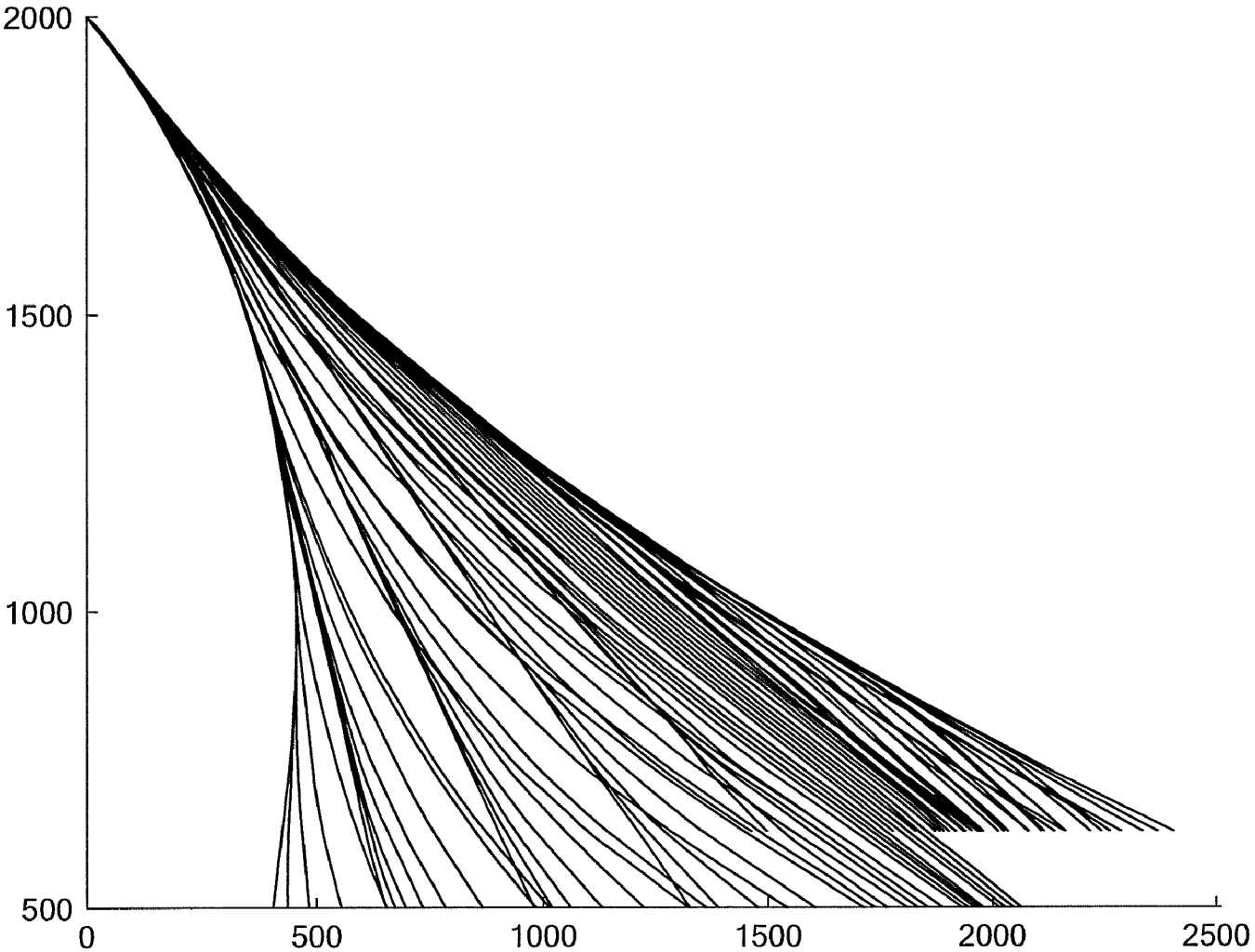

FIGS. 4A-4D show an exemplary illustration of a search tree generation. As can be seen, branches are generated for each altitude increment. FIGS. 4A and 4B show first and second snapshots of branch generation at a first altitude. As can be seen the branches grow, as described in detail below, to create paths to the target. FIGS. 4C and 4D show further sequential snapshots of branch generation at a second altitude closer to the target.

Figure 5:
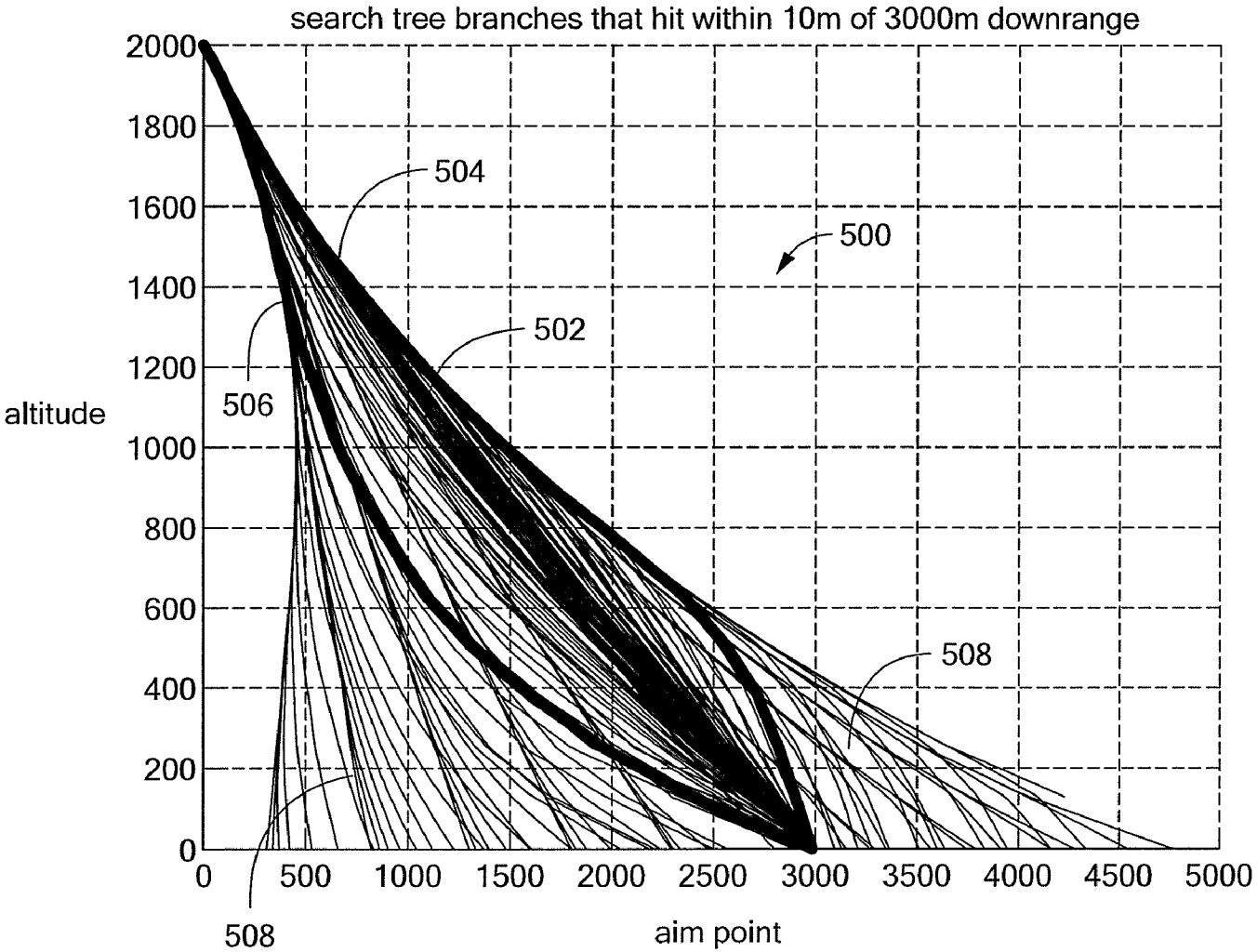
FIG. 5 is a waypoint search tree for a target in accordance with exemplary embodiments of the invention.
Figure 5A:
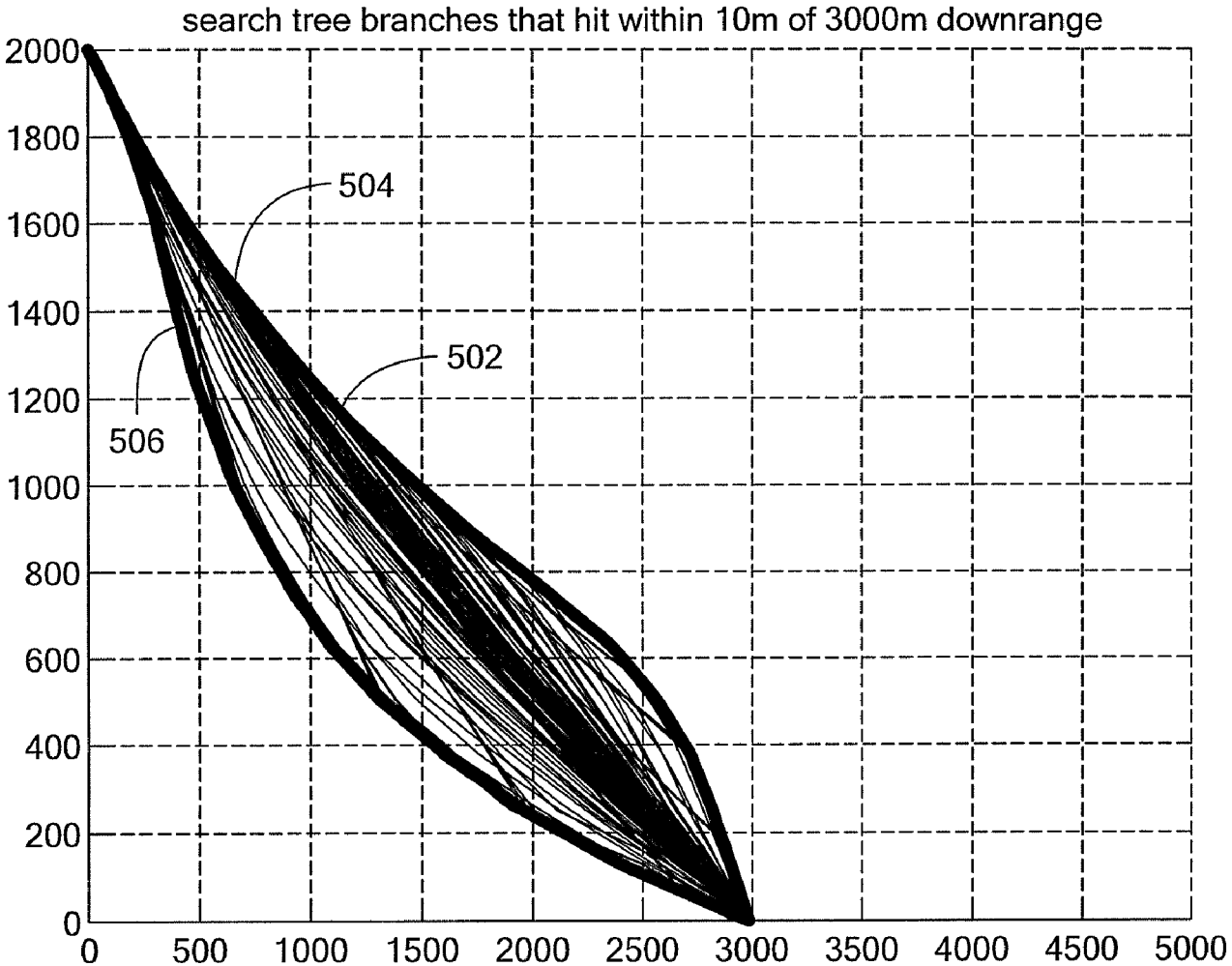
FIG. 5A is a waypoint search tree showing the valid paths in FIG. 5.

FIG. 5 shows a completed search tree 500 with valid paths 502 contained within bounding paths 504, 506. FIG. 5A shows just the valid paths 502. Paths 508 that impact terrain or violate airspace are terminated at the altitude where a violation occurs. The illustrated result is a one-waypoint search tree for a target at 3000 meters downrange. The first bounding path 504 is an upper trajectory boundary and the second boundary path 506 is a lower trajectory bounding path for the munition. Feasible paths 502 extend from an initial position to within a predetermined distance of the target.

Figure 6:
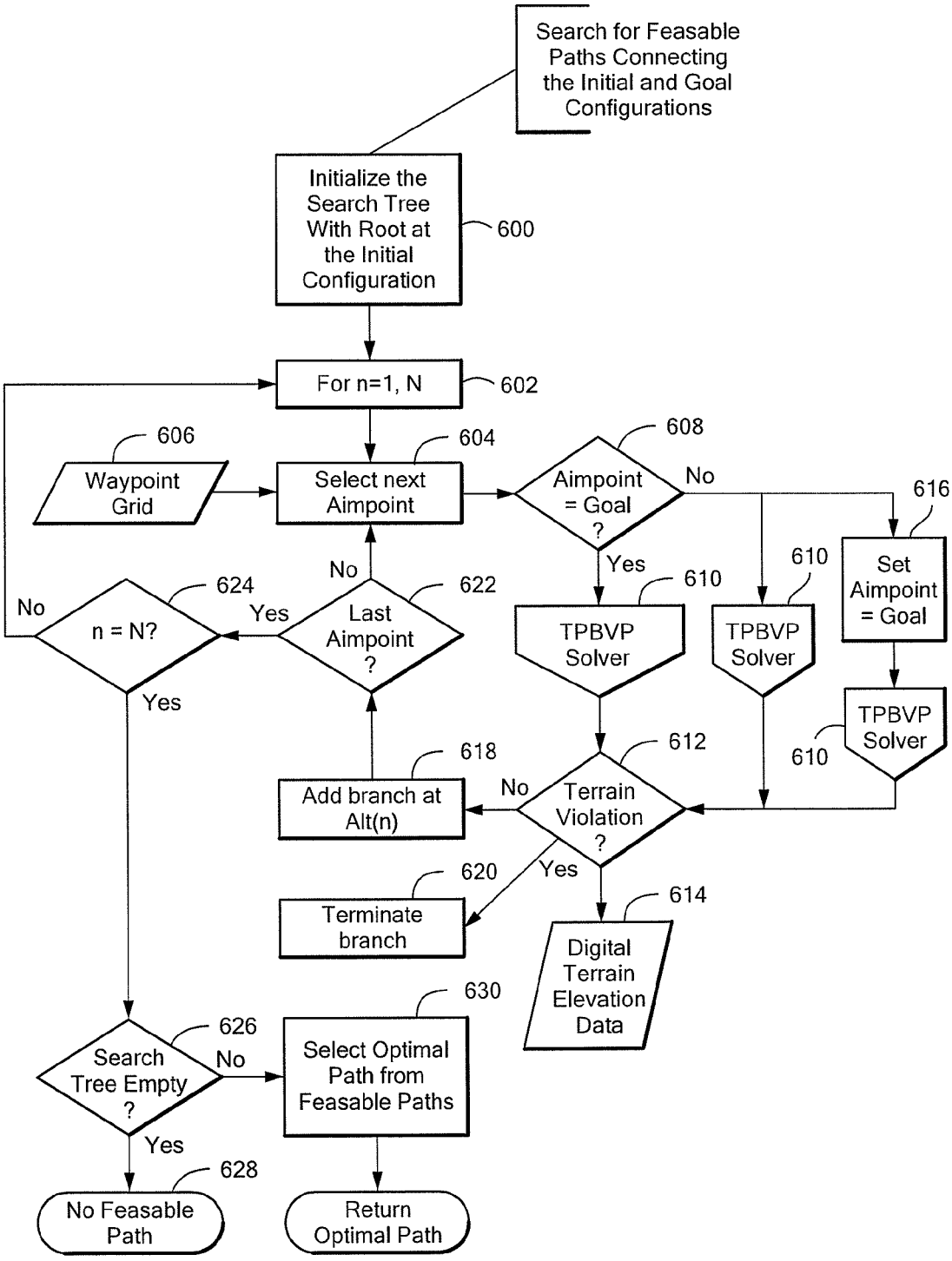
FIG. 6 is a flow diagram of an exemplary sequence of steps for determining feasible paths for the munition to target.

FIG. 6 shows an exemplary sequence of steps to generate feasible paths for connecting initial and goal configurations in accordance with exemplary embodiments of the invention. In step 600, the search tree is initialized with roots at the initial configuration, which can include altitude, velocity, position, etc. In step 602, at a given point in the search tree, in step 604, the next aimpoint is selected with associated waypoint data 606.

In step 608, it is determined whether the aimpoint equals the goal. If so, in step 610, the system performs two-point boundary value problem processing and determines in step 612 whether a terrain violation has occurred based upon terrain data 614.

As can be seen the TBVP solver processing step 610 occurs in both paths from after the "no" path from step 608. Any branch that is not aimed at the goal generates two children: one that continues to the waypoint (and will itself generate two children at the next altitude step), and one that switches to the goal (and generates only one child aimed at the goal at the next altitude step). This makes the search tree complexity linear in the depth of the tree.

It is understood that this is readily generalized to two waypoints (three aimpoints—the two waypoints and the goal) as follows: any branch aimed at waypoint 1 generates three children—the first aimed at waypoint 1, the second aimed at waypoint 2, and the third aimed at the goal. Any branch aimed at waypoint 2 generates two children—the first aimed at waypoint 2 and the second aimed at the goal. Any branch aimed at the goal generates one child aimed at the goal. And so on for more waypoints. This is the waypoint-based search tree providing an advantage in that it remains dense in the search space but the number of branches grows linearly with the depth of the tree. A binary search tree is exponential in the depth of the tree.

If no terrain violation occurred, in step 618 a branch is added. If a terrain violation did occur, the branch is terminated in step 620. In step 622, it is determined whether processing is at the last aimpoint. If not, in step processing continues in step 604. If so, in step 624 it is determined whether the final step has been processed. If not, processing continues in step 602. If so, in step 626, it is determined whether the search tree is empty. If so, then no feasible paths have been identified 628. If not, in step 630 an optimal path is selected from the identified feasible paths.

Figure 6A:
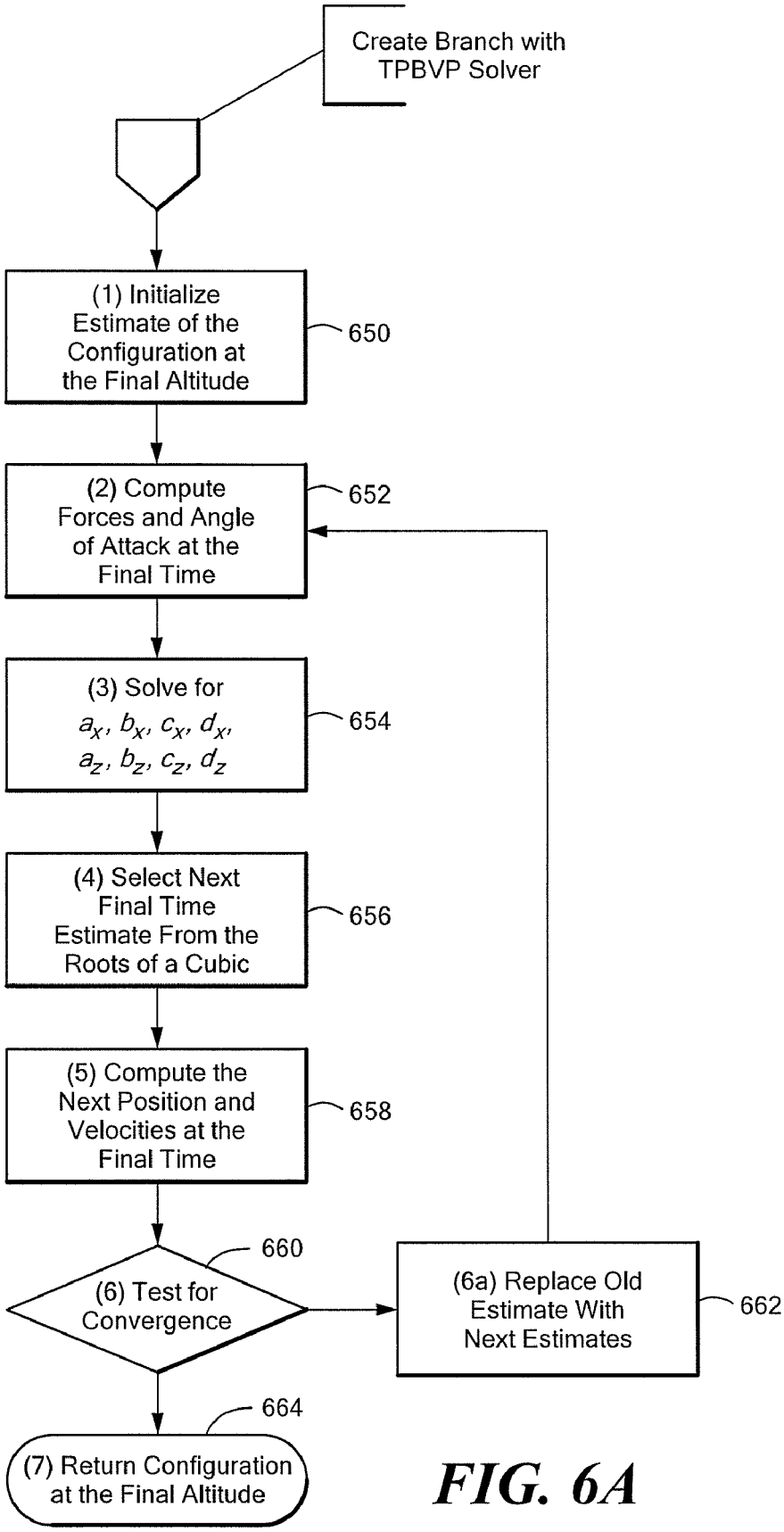
FIG. 6A is a flow diagram of an exemplary sequence of steps for boundary value processing in accordance with exemplary embodiments of the invention.

FIG. 6A shows further processing details for TPBVP. In step 650, the system initializes an estimate of the configuration at the final altitude. In step 652, the system computes the forces and angle of attack on the munition at the final time. The system then solves for coefficients in step 654, as described more fully below. In step 656, the system selects the final time estimate from the roots of a cubic and in step 658, computes the next position and velocities at the final time. In step 660, it is determined whether there is convergence. If not, the old estimate is replaced with the next estimate in step 662 and processing continues in step 652. If so, in step 664, the system returns the configuration for the final altitude. Further processing details are set forth below in the examples.

EXAMPLES

For the cases considered here the initial configuration is at an altitude of 2000 meters, mach 0.8, pitch 45 degrees, and angle of attack zero. The guidance loop, which has the autopilot loop interior and typically uses one of the proportional navigation laws well known in the art, is here a pure proportional navigation (PPN) guidance law with K=6 and where $\tau$=0.3 seconds is used to model the closed loop time constant. The search tree is formed at equally spaced altitudes by permitting trajectories that have not switched to the final aimpoint to create two children at the next lowest altitude, one that continues toward the waypoint, and one the switches to the final aim-point. Trajectories that have switched to the final aim-point (goal) create only one child. Thus, the number of branches at any altitude is a linear function of the depth of the search tree, avoiding the exponential growth of a binary tree. The configuration at the next altitude in the search tree is obtained by an efficient solution of the two-point boundary value problem, as described below. This iterative method will sometimes fail to converge to a reasonable solution if the altitude steps are too large. Rather than expand the search tree, all branches that fail the convergence test at some altitude are terminated. In practice, only a small percentage of branches are lost, and the search tree remains dense enough to find many feasible paths. For the test cases presented here only one branch was lost in each of the search trees.

The equations of motion for the three degree of freedom model can be written as $$\ddot{x}=F_x(z,\dot{x},\dot{z},\alpha)/M$$

$$\ddot{z}=F_z(z,\dot{x},\dot{z},\alpha)/M-g \tag{4}$$

where the pitch, autopilot, and guidance loop dynamics are approximated by $$\dot{\alpha}=(\alpha_d(x,z,\dot{x},\dot{z},x_{Aim})-\alpha)/\tau \tag{5}$$

and where M is mass, g the acceleration of gravity, $\alpha$ the angle of attack, $\tau$ the guidance loop time constant, and $x_{Aim}$, the aim-point. As is well known in the art, force can be defined as the change in momentum (mv) over time, or where mass is constant, F=ma (force=mass×acceleration), velocity v is the change in position over time, and acceleration, or rate of change of velocity, is the derivative of the velocity with respect to time (the second derivative of the position with respect to time).

The forces $F_x$ and $F_z$ depend upon angle of attack, elevator angle, dynamic pressure, lift and drag coefficients, and pitch angle as seen in equations (1)-(3). The pitch angle is computed from the velocity vector and angle of attack. The elevator angle is set to the angle that yields zero pitching moment, assuming a fast autopilot loop, and then the lift and drag coefficients are obtained by a table look up on angle of attack, elevator angle, and mach number. The desired angle of attack, $\alpha_d$, is obtained by using pure proportional navigation (PPN) to compute the desired force normal to the velocity vector from the rate of the line of sight angle and then interpolating to determine the desired angle of attack.

In one particular embodiment, Equations (4) and (5) can be efficiently solved as an initial value problem, by using the Matlab Runge-Kutta integration routines, if the initial configuration ($x_i$, $z_i$, $\dot{x}_i$, $\dot{z}_i$, $\alpha_1$) is given and the final time $t_f$ is known. Given the final altitude $z_f$, equations (4) and (5) can be solved as a two point boundary value problem (TPBVP) by using a shooting method, for example, to find the final time that yields the desired final altitude. To efficiently solve this TPBVP, the downrange and altitude coordinates are given parametrically in the form $$x(t)=a_xt^3+b_xt^2+c_xt+d_x$$

$$z(t)=a_zt^3+b_zt^2+c_zt+d_z \tag{6}$$

Note that there are five initial conditions in the initial configuration, four of which apply to x and z in (3). From (4) and (6) it follows that $$6a_xt_i+2b_x=F_x(z_i,\dot{x}_i,\dot{z}_i,\alpha_i)/M$$

$$6a_zt_i+2b_z=F_z(z_i,\dot{x}_i,\dot{z}_i,\alpha_i)/M-g \tag{7}$$

which yields two more relations from the initial configuration. Two more relations can be obtained from (4), (5), and (6) as $$6a_x t_f + 2b_x = F_x(z_f, \dot{x}_f, \dot{z}_f, \alpha_f) \quad (8)$$

$$6a_z t_f + 2b_z = F_z(z_f, \dot{x}_f, \dot{z}_f, \alpha_f)/M - g$$

$$\alpha_f = \alpha_i e^{-\frac{t_f - t_i}{\tau}} + \alpha_d(x_t, z_t, \dot{x}_t, \dot{z}_t, x_{Aim})\left(1 - e^{-\frac{t_f - t_i}{\tau}}\right)$$

by assuming that $\alpha_d$ is constant over the interval $(t_i, t_f)$. It can be useful to use the average of the desired force computed at the start and end of each altitude step in the computation of $\alpha_d$. In (8), $z_f$ is known and $t_f$, $\dot{x}_f$, and $\dot{z}_f$ are not known. If those quantities were known it would be possible to solve a linear two by two system for $a_x$ and $b_x$ and also for $a_z$ and $b_z$ using (7) and (8). The remaining unknowns, $c_x$, $d_x$, $c_z$, and $d_z$, can then be obtained easily from the initial configuration using back substitution. The TPBVP is solved using the following iterative procedure:

1. Given $(x_i, z_i, \dot{x}_i, \dot{z}_i, \alpha_i)$ at $t_i$, set:

$$\dot{x}_f \leftarrow \dot{x}_i,\ \dot{z}_f \leftarrow \dot{z}_i,\ t_f \leftarrow t_i + \frac{z_f - z_i}{\dot{z}_f},\ x_f \leftarrow x_i + (t_f - t_i)\dot{x}_f \quad \text{(STEP 650)}$$

2. Compute $\alpha_f$, $F_x$ and $F_z$ at $t_f$ for the linear system coefficients (STEP 652)

3. solve the linear system for $a_x$, $b_x$, $c_x$, $d_x$, $a_z$, $b_z$, $c_z$, $d_z$. (STEP 654)

4. Select $t'_f$ from the roots of $a_z t^3 + b_z t^2 + c_z t + d_z = z_f$ (STEP 656)

5. set:

$$\dot{x}'_f \leftarrow 3a_x t'^2_f + 2b_x t'_f + c_x, \dot{z}'_f \leftarrow 3a_z t'^2_f + 2b_z t'_f + c_z, x'_f \leftarrow a_x t'^3_f + b_x t'^2_f + c_x t'_f + d_x$$

(STEP 658)

6. if $(|t_f - t'_f| > \eta)$OR$(|x_f - x'_f| > \epsilon)$OR$(|\dot{x}_f - \dot{x}'_f| > \delta)$OR$(|\dot{z}_f - \dot{z}'_f| > \delta)$(STEP 660)

a. $\dot{x}_f \leftarrow \dot{x}'_f$, $\dot{z}_f \leftarrow \dot{z}'_f$, $t_f \leftarrow t'_f$, $x_f \leftarrow x'_f$ (STEP 662)

b. go to 2

7. return the final configuration, $(x_f, z_f, \dot{x}_f, \dot{z}_f, \alpha_f)$, at $t_f$. (STEP 664)

With regard to values for $\eta$, $\epsilon$, and $\delta$, it is understood that this procedure incorporates the iterative form $x_{n+1} = f(x_n)$, which will converge if $|f(x)| < 1$ in the neighborhood of the root, and if the iteration is initialized 'close enough' to the desired root of $x = f(x)$. The iteration makes use of tabulated aerodynamic data and a judicious test for divergence. In particular, it was found that monitoring the 2-norm of the error between the coefficient vectors at each iterative step would indicate when the iteration had entered a limit cycle (norm is constant) or was diverging (norm increases) to facilitate an early exit.

It is understood that detection of terrain or airspace violations requires the calculation of the intersection of a line segment and a triangle in 3D, for example. Terrain can be represented with digital terrain elevation data (DTED) and triangulated to create a triangulated irregular network (TIN) overlaying the terrain—this is the origin of the triangles to test. Such calculations are well known to those skilled in the art (see, e.g., Handbook of Discrete and Computational Geometry, Jacob E. Goodman and Joseph O'Rourke (eds.), Chapman & Hall/CRC, 2004.)

Referring again to FIG. 5, in practice those branches that impact terrain or violate airspace will be terminated at the altitude where the violation occurs. To facilitate understanding of the invention embodiments, such obstacles have been omitted. The search tree was generated for 16 levels, from 2 km to the ground in 125 meter steps.

Figure 7A:
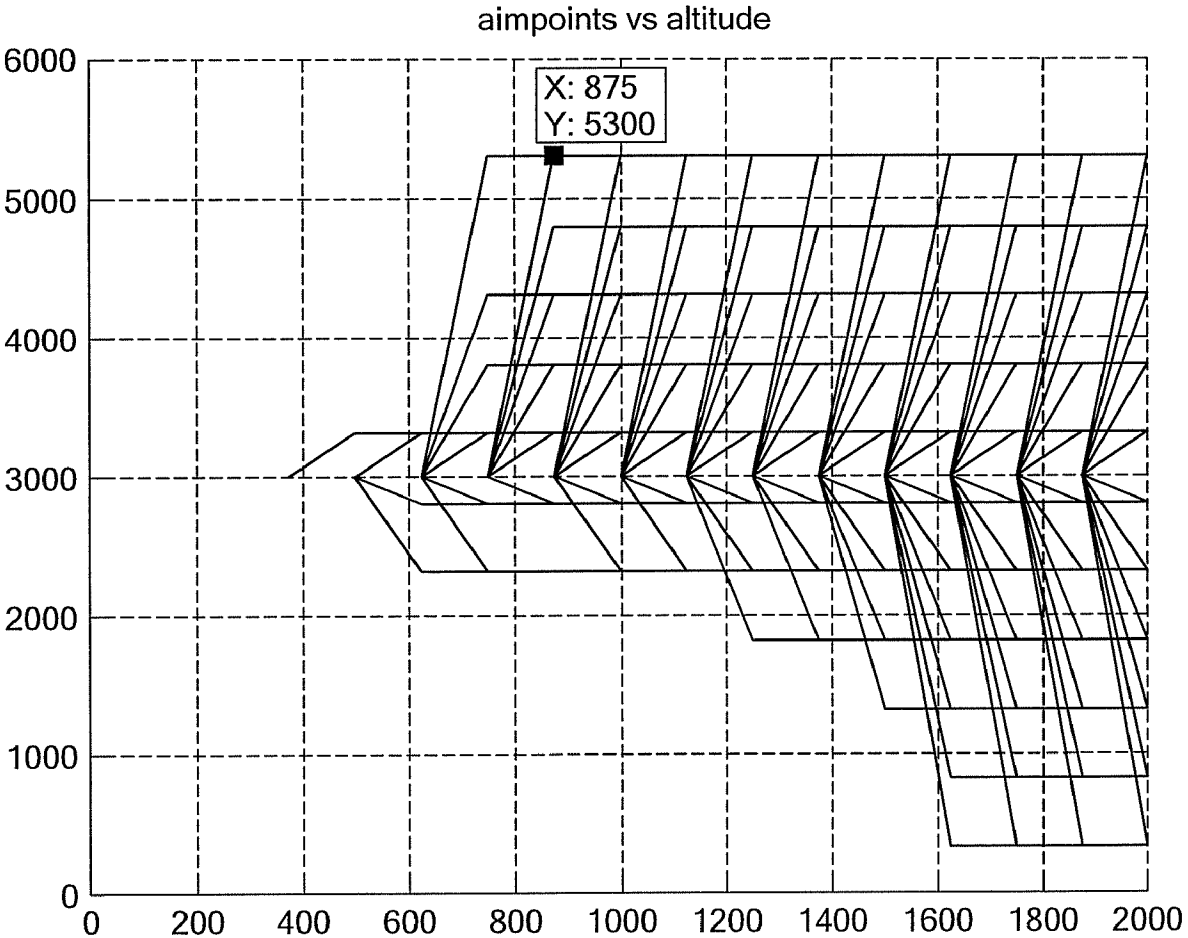
FIGS. 7A and 7B are graphical representations of aimpoints for respective bounding trajectories for the munition.
Figure 7B:
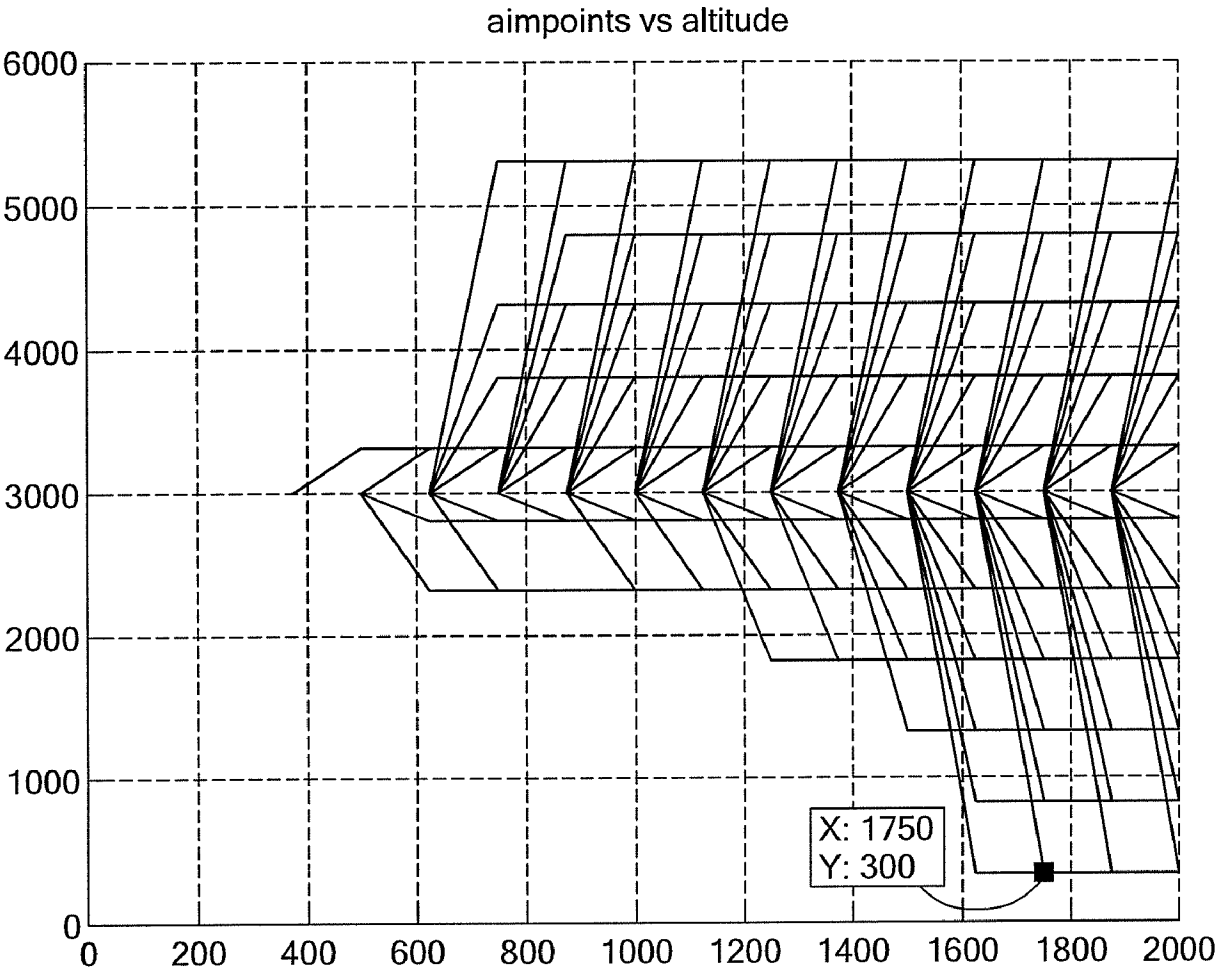

The aim-points vs. altitude are shown in FIGS. 7A and 7B. For the upper bounding trajectory the waypoint is at 5300 meters downrange to an altitude of 875 meters, then the aim-point is 3000 meters to impact. For the lower bounding trajectory the waypoint is at 300 meters downrange to an altitude of 1750 meters, then the aim-point is 3000 meters to impact.

The bounding trajectory waypoints are generated as follows. The search tree has an associated data structure where the aimpoint at each altitude is saved. To find the altitude at which the aimpoint changed from a waypoint to the goal, follow the branches for feasible paths from the goal back to the root of the tree. For this particular path, the munition was aimed at a waypoint (5300 meters downrange from the initial configuration) until the munition reached 875 meters in altitude at which time the aimpoint switched to the goal (3000 meters downrange of the initial configuration).

Figure 8A:
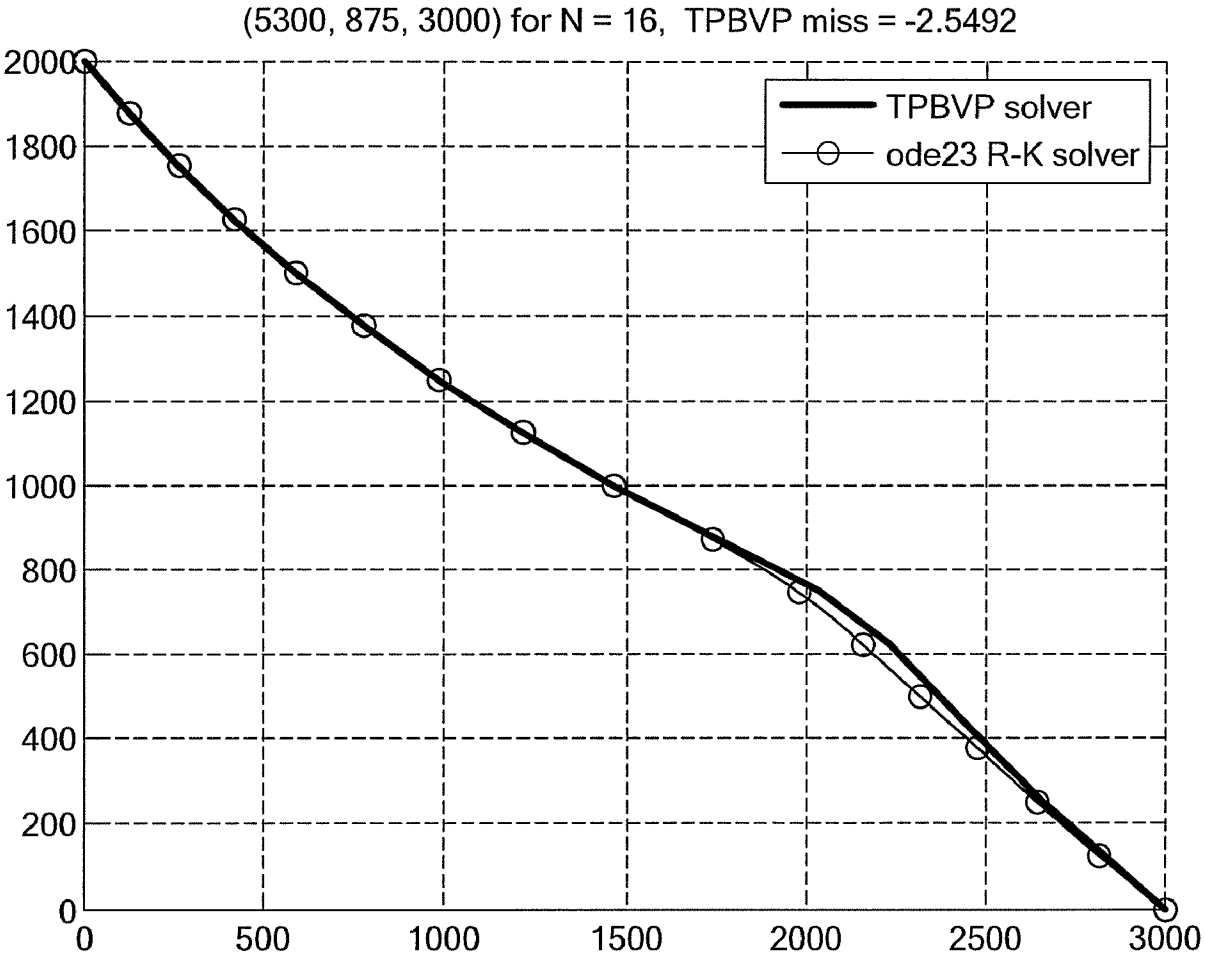
FIGS. 8A and 8B are graphical representations of waypoint validations for the aimpoints of FIGS. 7A and 7B.
Figure 8B:
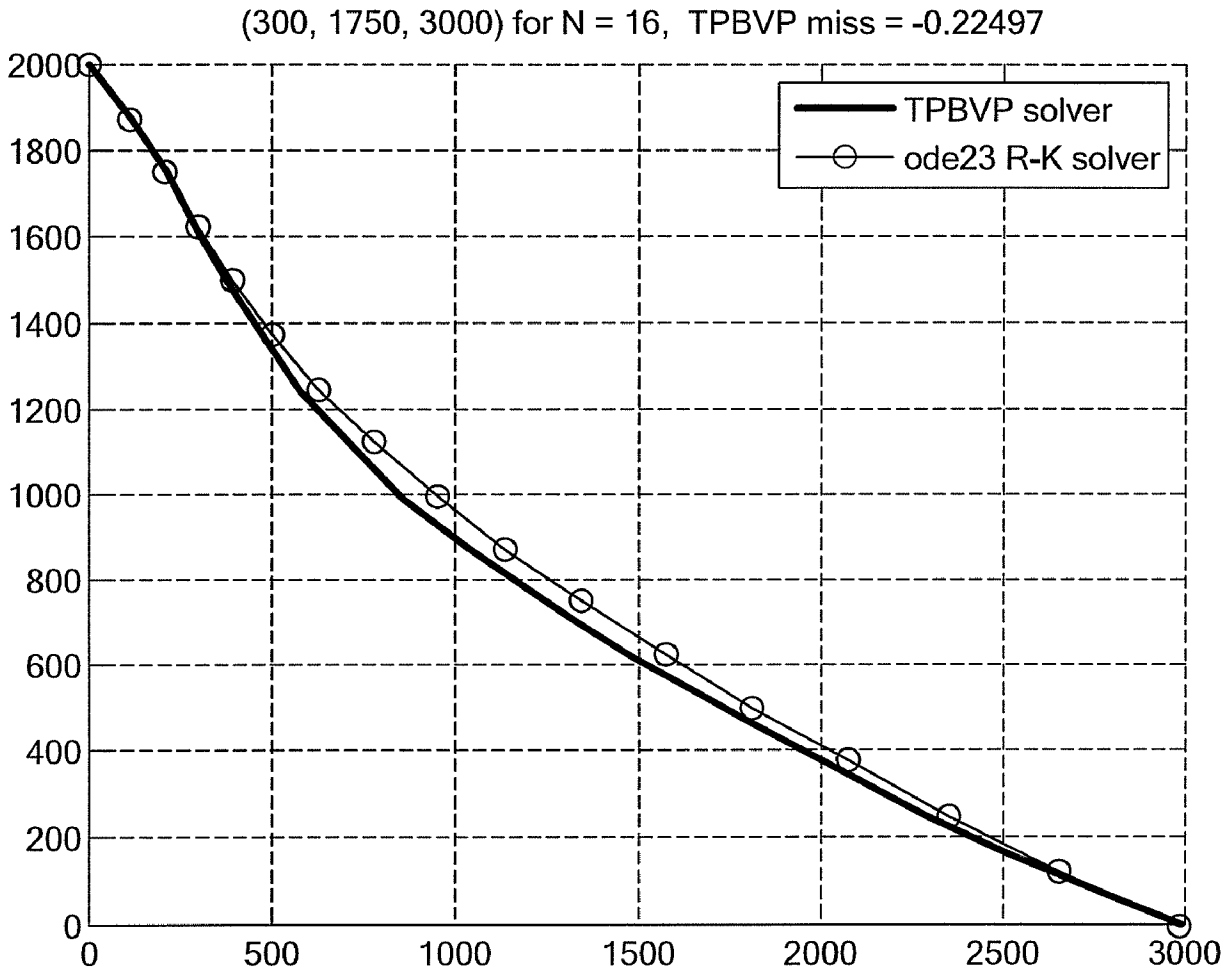

The waypoints are validated in FIGS. 8A and 8B by integrating the governing differential equations (using the waypoints) up to impact. Note that the bounding trajectories indicate that only a limited amount of trajectory shaping can be accomplished. Nevertheless, an obstacle at 2500 meters downrange with a height of 300 meters can be cleared by 50 meters using the upper bounding trajectory.

Figure 9:
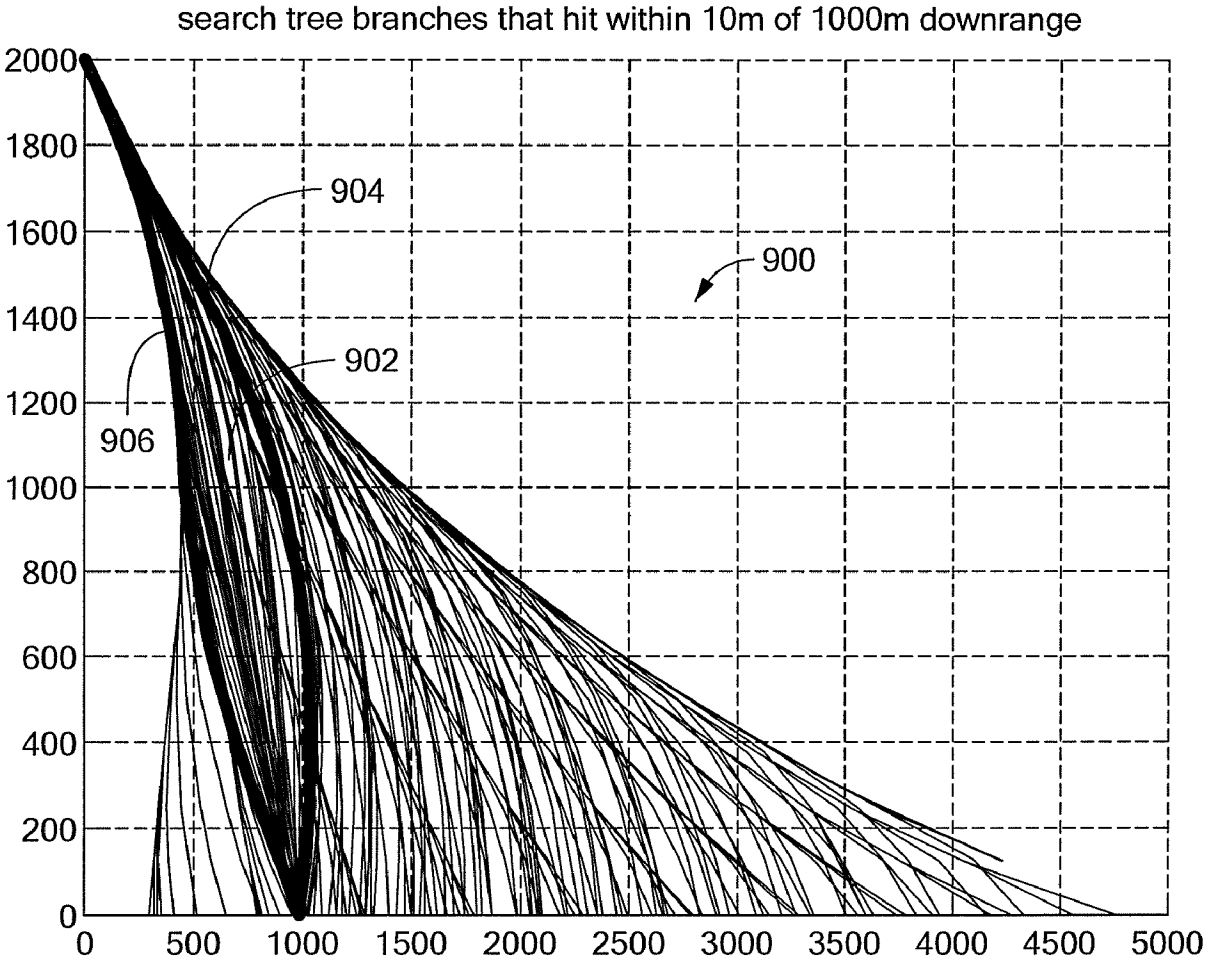
FIG. 9 is a further waypoint search tree for a munition.

FIG. 9 shows results 900 for a target 1000 meters downrange. In practice those branches that impact terrain or violate airspace will be terminated at the altitude where the violation occurs. For illustration, such obstacles have been omitted. The search tree was generated for 16 levels, from 2 km to the ground in 125 meter steps. Valid paths 902 are shown within the bounding paths 904, 906.

While the invention is shown and described in conjunction with exemplary embodiments, such as a GPS-guided munition, it is understood that the invention is applicable to a variety of guidable objects for which path planning is desirable. Exemplary embodiments of the invention are described using data having three degrees of freedom for two-dimensional path planning. It is understood that embodiments having three dimensional path planning are well within the scope of the invention.

Exemplary embodiments of the invention are shown having illustrative partitions of hardware and software. Alternative embodiments having different apportionment between hardware and software to meet the needs of a particular application will be readily apparent to one of ordinary skill in the art. In addition, the inventive processing can be implemented in computer programs executed on programmable computers/machines that each includes a processor, a storage medium or other article of manufacture that is readable by the processor (including volatile and non-volatile memory and/or storage elements), at least one input device, and one or more output devices.

The system may be implemented, at least in part, via a computer program product, (e.g., in a machine-readable storage device), for execution by, or to control the operation of, data processing apparatus (e.g., a programmable processor, a computer, or multiple computers)). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment.

A computer program may be deployed to be executed on one computer or on multiple computers at one site or distributed across multiple sites and interconnected by a communication network. A computer program may be stored on a storage medium or device (e.g., CD-ROM, hard disk, or magnetic diskette) that is readable by a general or special purpose programmable computer for configuring and operating the computer when the storage medium or device is read by the computer.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A method, comprising:

(a) planning a path to a target for an airborne guided munition, comprising:

(b) initiating a search tree;

(c) selecting an aimpoint using waypoint information to generate a branch of the search tree for a potential path to the target;

(d) performing two point boundary value processing for the aimpoint to generate the branch;

(e) determining whether a violation occurs for the branch;

(f) adding the branch to the search tree if the violation did not occur;

(g) repeating steps (c)-(f) to form feasible paths to the target from the formed branches; and (h) selecting a first one of the feasible paths.

2. The method according to claim 1, wherein the violation includes terrain impact and/or airspace violation.

3. The method according to claim 1, further including generating an upper bounding, in arrival time or angle, trajectory for the munition having a downrange value and an altitude value.

4. The method according to claim 3, further including generating a lower bounding, in arrival time or angle, trajectory for the munition.

5. The method according to claim 1, further including computing forces on the munition and angle of attack for a given time;

solving for linear coefficients of a parametric representation for downrange and altitude coordinates;

selecting a next time estimate from roots of the parametric representation;

computing position and velocity for the munition for the next time estimate; and testing for convergence.

6. The method according to claim 5, wherein the parametric representation includes a cubic.

7. The method according to claim 5, further including generating an upper bounding trajectory for the munition having an aimpoint and altitude.

* * * * *